US010653575B2

(12) United States Patent
Stroh et al.

(10) Patent No.: US 10,653,575 B2
(45) **Date of Patent: *May 19, 2020**

(54) PATIENT SUPPORT APPARATUS AND METHODS

(71) Applicant: HUNTLEIGH TECHNOLOGY LIMITED, Bedfordshire (GB)

(72) Inventors: Glenn C. Stroh, Marion, TX (US); John H. Vrzalik, San Antonio, TX (US); Cesar Lina, Universal City, TX (US)

( * ) Notice: Subject to any disclaimer, the term of this patent is extended or adjusted under 35 U.S.C. 154(b) by 564 days.

This patent is subject to a terminal disclaimer.

(21) Appl. No.: 14/961,579

(22) Filed: Dec. 7, 2015

(65) Prior Publication Data

US 2016/0220435 A1 Aug. 4, 2016

Related U.S. Application Data

(63) Continuation of application No. 13/221,528, filed on Aug. 30, 2011, now Pat. No. 9,205,010.

(60) Provisional application No. 61/379,251, filed on Sep. 1, 2010, provisional application No. 61/409,365, filed on Nov. 2, 2010.

(51) Int. Cl.

| | |
|---|---|
| ***A61G 7/015*** | (2006.01) |
| ***A61G 7/057*** | (2006.01) |
| ***A61G 7/018*** | (2006.01) |
| ***A61G 7/05*** | (2006.01) |
| ***A47C 27/10*** | (2006.01) |

(52) U.S. Cl.

CPC ..... *A61G 7/015* (2013.01); *A47C 27/10* (2013.01); *A61G 7/018* (2013.01); *A61G 7/0506* (2013.01); *A61G 7/05769* (2013.01); *A61G 7/05776* (2013.01); *A61G 2203/34* (2013.01); *A61G 2203/42* (2013.01)

(58) Field of Classification Search

CPC ..... A61G 7/015; A61G 7/018; A61G 7/0506; A61G 2203/34; A61G 2203/42; A61G 7/05776; A47C 27/10; A47C 27/082; A47C 27/083

See application file for complete search history.

(56) References Cited

U.S. PATENT DOCUMENTS

| | | | | |
|---|---|---|---|---|
| 3,839,753 | A | 10/1974 | Benoit et al. | 5/618 |
| 4,109,329 | A | 8/1978 | Tupper | 5/607 |
| 4,391,009 | A | 7/1983 | Schild et al. | 5/713 |
| 5,020,176 | A | 6/1991 | Dotson | |
| 5,279,010 | A | 2/1994 | Ferrand et al. | 5/600 |

(Continued)

FOREIGN PATENT DOCUMENTS

| | | |
|---|---|---|
| CN | 101219024 A | 7/2008 |
| EP | 1 920 681 | 5/2008 |

(Continued)

OTHER PUBLICATIONS

Canadian Office Action dated Aug. 27, 2015, issued for Canadian Application No. 2,810,225, 6 pages.

(Continued)

*Primary Examiner* — Nicholas F Polito
(74) *Attorney, Agent, or Firm* — The Webb Law Firm

(57) ABSTRACT

Improved patient-support apparatuses and methods for rapid mattress inflation and pressure-compensation for changes in patient position.

13 Claims, 10 Drawing Sheets

(56) References Cited

U.S. PATENT DOCUMENTS

| | | | | |
|---|---|---|---|---|
| 5,611,096 | A * | 3/1997 | Bartlett | A61G 7/001 5/424 |
| 5,802,640 | A | 9/1998 | Ferrand et al. | 5/617 |
| 6,611,979 | B2 | 9/2003 | Welling et al. | 5/624 |
| 6,658,680 | B2 | 12/2003 | Osborne et al. | 5/600 |
| 6,691,346 | B2 | 2/2004 | Osborne et al. | 5/600 |
| 6,829,796 | B2 | 12/2004 | Salvatini et al. | 5/713 |
| 6,957,461 | B2 | 10/2005 | Osborne et al. | 5/618 |
| 6,978,500 | B2 | 12/2005 | Osborne et al. | 5/600 |
| 7,171,708 | B2 | 2/2007 | Osborne et al. | 5/618 |
| 7,310,839 | B2 | 12/2007 | Salvatini et al. | 5/280 |
| 7,454,805 | B2 | 11/2008 | Osborne et al. | 5/618 |
| 7,520,006 | B2 | 4/2009 | Menkedick et al. | 5/618 |
| 7,610,637 | B2 | 11/2009 | Menkedick et al. | 5/611 |
| 7,627,910 | B2 | 12/2009 | Davis | 5/81.1 R |
| 7,657,956 | B2 | 2/2010 | Stacy et al. | 5/713 |
| 7,669,263 | B2 | 3/2010 | Menkedick et al. | 5/624 |
| 7,685,658 | B2 | 3/2010 | Lokhorst et al. | 5/424 |
| 7,690,059 | B2 | 4/2010 | Lemire et al. | 5/600 |
| 7,703,158 | B2 | 4/2010 | Wilker, Jr. et al. | 5/616 |
| 7,714,238 | B2 | 5/2010 | Skinner et al. | 177/144 |
| 7,739,763 | B2 * | 6/2010 | Wang | A47C 27/082 5/710 |
| 7,761,945 | B2 | 7/2010 | Butler | 5/713 |
| 7,784,128 | B2 | 8/2010 | Kramer | 5/624 |
| 7,784,130 | B2 | 8/2010 | Pile | 5/713 |
| 9,205,010 | B2 * | 12/2015 | Stroh | A61G 7/05776 |
| 2001/0023511 | A1 * | 9/2001 | Wilkinson | A47C 27/084 5/713 |
| 2001/0029628 | A1 | 10/2001 | Ferrand et al. | 5/600 |
| 2004/0034936 | A1 | 2/2004 | Welling et al. | 5/624 |
| 2004/0237203 | A1 | 12/2004 | Romano et al. | 5/713 |
| 2006/0096029 | A1 | 5/2006 | Osborne et al. | 5/618 |
| 2007/0174964 | A1 | 8/2007 | Lemire et al. | 5/600 |
| 2008/0060138 | A1 * | 3/2008 | Price | A61B 5/0205 5/713 |
| 2009/0237264 | A1 * | 9/2009 | Bobey | A61G 7/05776 340/815.69 |
| 2009/0249552 | A1 | 10/2009 | Chambers et al. | 5/713 |
| 2009/0313758 | A1 | 12/2009 | Menkedick et al. | 5/618 |
| 2010/0043143 | A1 | 2/2010 | O'Reagan | 5/421 |
| 2010/0063638 | A1 | 3/2010 | Skinner | |
| 2010/0095462 | A1 | 4/2010 | Bobey et al. | 5/713 |
| 2010/0101022 | A1 | 4/2010 | Riley et al. | 5/600 |
| 2010/0132116 | A1 | 6/2010 | Stacy et al. | 5/423 |
| 2010/0132124 | A1 | 6/2010 | Liu et al. | 5/713 |
| 2010/0199432 | A1 | 8/2010 | Rawls-Meehan | 5/617 |

FOREIGN PATENT DOCUMENTS

| | | | |
|---|---|---|---|
| JP | S58122380 | A | 7/1983 |
| JP | H09224982 | A | 9/1997 |
| JP | H10140 | A | 1/1998 |
| JP | 2002-045404 | A | 2/2002 |
| JP | 2005-218731 | A | 8/2005 |
| WO | WO 2002/045656 | | 6/2002 |
| WO | 2009/072253 | A1 | 6/2009 |

OTHER PUBLICATIONS

PCT Invitation to pay Additional Fees and Partial Search Report issued in International application No. PCT/US2011/049745 dated Dec. 5, 2011.

* cited by examiner

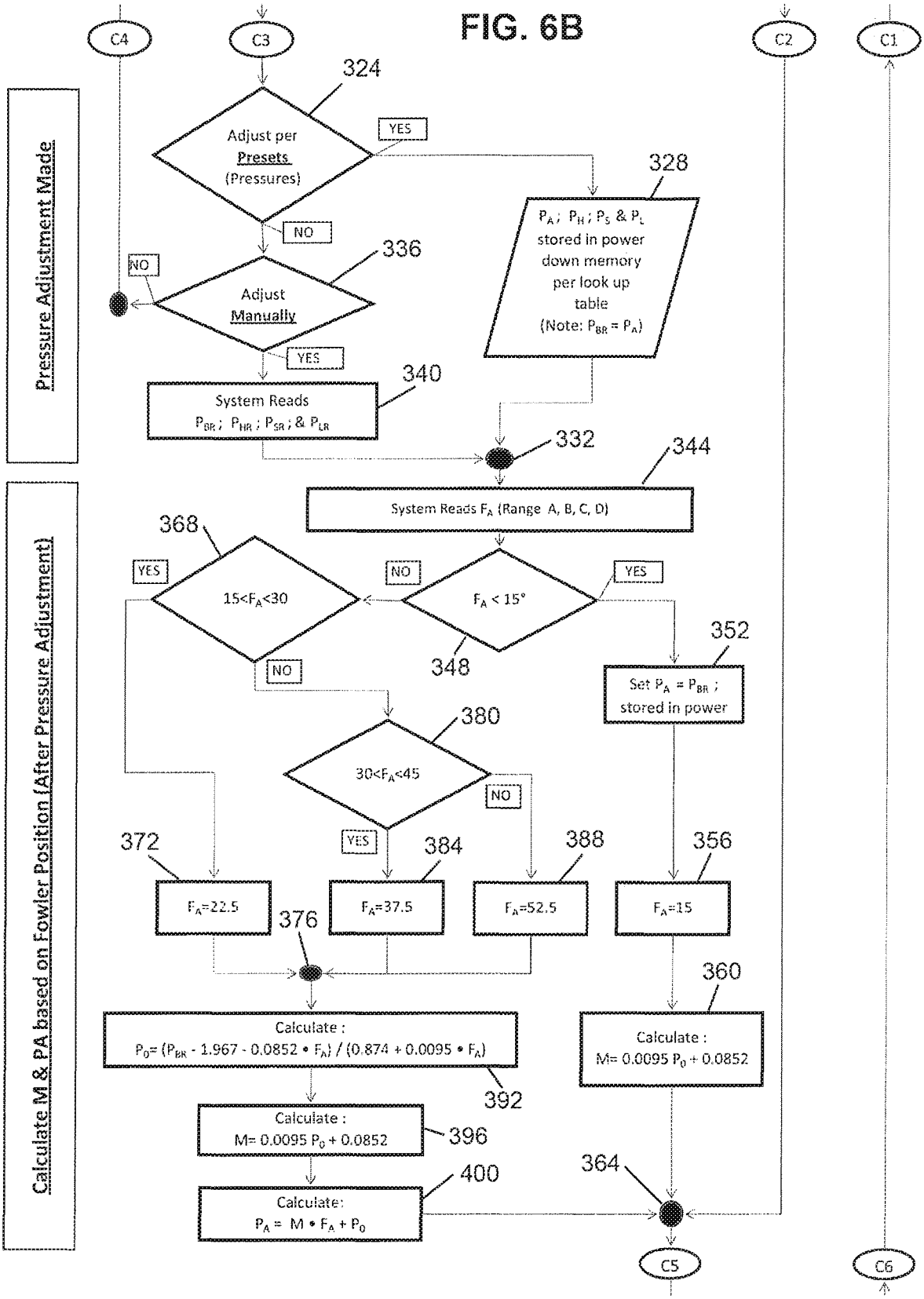
FIG. 6B
C4
C3
C2
C1
Pressure Adjustment Made
Calculate M & PA based on Fowler Position (After Pressure Adjustment)
324
Adjust per Presets (Pressures)
YES
NO
328
$P_A$; $P_H$; $P_S$ & $P_L$ stored in power down memory per look up table (Note: $P_{BR} = P_A$)
336
Adjust Manually
NO
YES
340
System Reads $P_{BR}$; $P_{HR}$; $P_{SR}$; & $P_{LR}$
332
344
System Reads $F_A$ (Range A, B, C, D)
368
$15<F_A<30$
YES
NO
$F_A < 15°$
YES
348
352
Set $P_A = P_{BR}$; stored in power
NO
380
$30<F_A<45$
NO
YES
372
384
388
356
$F_A$=22.5
$F_A$=37.5
$F_A$=52.5
$F_A$=15
376
360
Calculate : $P_0 = (P_{BR} - 1.967 - 0.0852 \cdot F_A) / (0.874 + 0.0095 \cdot F_A)$
392
Calculate : $M = 0.0095\ P_0 + 0.0852$
Calculate : $M = 0.0095\ P_0 + 0.0852$
396
400
364
Calculate: $P_A = M \cdot F_A + P_0$
C5
C6

PATIENT SUPPORT APPARATUS AND METHODS

CROSS-REFERENCE TO RELATED APPLICATIONS

This application is a continuation of U.S. Non-provisional application Ser. No. 13/221,528 filed Aug. 30, 2011 pursuant to 35 USC § 120(d), which in turn claims priority to: (1) U.S. Provisional Patent Application No. 61/379,251, filed Sep. 1, 2010 pursuant to 35 USC § 119(e); and (2) U.S. Provisional Patent Application No. 61/409,365, filed Nov. 2, 2010 pursuant to 35 USC § 119(e); all of which are incorporated by reference herein in their entirety.

BACKGROUND

1. Field of the Invention

The present invention relates generally to beds and patient support surfaces, and, more particularly, but not by way of limitation, to patient supports having a mattress with one or more inflatable chambers.

2. Description of Related Art

Various apparatuses are known in the art for supporting patients. For example, some hospital and other beds include a mattress with a plurality of inflatable chambers (e.g., transverse chambers). Some such support apparatuses have an articulable frame that includes a back section, a seat section, and a leg section, each of which may be pivotable relative to one or more of the other sections.

SUMMARY

This disclosure includes embodiments of patient support apparatuses, control units, and methods.

Some embodiments of the present patient-support apparatuses comprise: a mattress with two or more inflatable zones; two or more primary fluid sources each having a first capacity and coupled to a corresponding one of the two or more inflatable zones; a secondary fluid source having a second capacity that is greater than the first capacity of each primary fluid source, the secondary fluid source coupled to the two or more inflatable zones; and a controller coupled to the two or more primary fluid sources and to the secondary fluid source, the controller configured to activate the secondary fluid source to provide fluid to the two or more zones if the pressure in at least one of the two or more zones is below a lower threshold pressure.

In some embodiments, the mattress comprises two or more layers, a first one of the two or more layers includes the two or more inflatable zones, and: the two or more primary fluid sources are configured to provide fluid to separate ones of the two or more zones in the first layer, and: the secondary fluid source is configured to provide fluid to the second layer. Some embodiments further comprise: an actuatable valve between the secondary fluid source and the two or more inflatable zones in the first of the two or more layers, where the controller is configured to close the actuatable valve if the pressure in the two or more inflatable zones reaches or exceeds the threshold pressure.

Some embodiments of the present patient-support apparatuses further comprise: two or more sensors configured to measure the pressure in the two or more zones of the mattress; where the controller is configured to receive signals from the two or more sensors indicative of the pressure in the two or more zones of the mattress.

Some embodiments of the present patient-support apparatuses further comprise: two or more check valves disposed between the secondary fluid source and the two or more zones of the mattress such that the two or more check valves permit fluid to flow through the two or more check valves away from the secondary fluid source, and substantially prevent fluid from flowing through the two or more check valves toward the secondary fluid source.

In some embodiments of the present patient-support apparatuses, the controller is configured to deactivate the secondary fluid source when the pressure in each of the two or more zones of the mattress reaches the lower threshold pressure. In some embodiments, the controller is configured to activate each of the primary fluid sources to provide fluid to the corresponding zones if the pressure in the corresponding zone is below a target pressure.

Some embodiments of the present patient-support apparatuses further comprise: a frame having a seat portion and a back portion configured to pivot between a lowered position and a raised position; a sensor configured to detect the angle of the back portion of the frame; and where the mattress is supported above at least a part of the frame; and where at least one of the two or more zones is a seat zone corresponding to the seat portion of the frame. In some embodiments, the controller is configured to isolate the seat zone if the angle of the back portion exceeds a threshold angle. In some embodiments, the controller is configured to activate the primary fluid source corresponding to the seat zone to increase the pressure in the seat zone if the angle of the back portion exceeds the threshold angle.

In some embodiments of the present control units for a mattress having two or more inflatable zones, the control unit comprises: two or more primary fluid sources each having a first capacity and configured to be coupled to a different one of the two or more zones of the mattress; a secondary fluid source having a second capacity that is greater than the first capacity of each primary fluid source, the secondary fluid source configured to be coupled to each of the two or more zones of the mattress; and a controller coupled to the two or more primary fluid sources and to the secondary fluid source; where the controller is configured such that if the primary fluid sources and the secondary fluid source are coupled to the two or more zones of an mattress, the controller will activate the secondary fluid source to provide fluid to the two or more zones if the pressure in at least one of the two or more zones is below a lower threshold pressure.

In some embodiments, the control unit is configured to be coupled to a mattress having two or more layers, in which a first one of the two or more layers includes the two or more inflatable zones, such that: the two or more primary fluid sources are configured to provide fluid to separate ones of the two or more zones in the first layer, and: the secondary fluid source is configured to provide fluid to the second layer. Some embodiments further comprise: an actuatable valve between the secondary fluid source and the two or more inflatable zones in the first of the two or more layers, where the controller is configured to close the actuatable valve if the pressure in the two or more inflatable zones reaches or exceeds the threshold pressure.

In some embodiments of the present methods of controlling air pressure in a multi-chamber inflatable mattress, the method comprises: detecting that the angle of a pivotable back section of a patient support is changing; and isolating one or more (e.g., all) seat chambers of the mattress until the angle of the back section stops changing.

Some embodiments of the present methods further comprise: receiving a signal indicative of the angle of a back section; and adjusting the pressure in the one or more (e.g., all) seat chambers if the angle of the back section exceeds a threshold angle. In some embodiments, adjusting the pressure comprises: activating one or more fluid sources to increase the pressure in one or more seat chambers. In some embodiments, adjusting the pressure comprises: releasing fluid from the one or more seat chambers to decrease the pressure in the one or more seat chambers. In some embodiments, the pressure in the seat chambers is adjusted to a target pressure level that corresponds to the angle of the back section. In some embodiments, the target pressure level is selected from among a plurality of predetermined pressures each corresponding to a different range of angles of the back section. In some embodiments, each of plurality of predetermined pressures increase with the magnitude of the corresponding angular range. In some embodiments, a first predetermined pressure corresponds to an angular range of 15-30 degrees; a second predetermined pressure corresponds to an angular range of 30-45 degrees; and a third predetermined pressure corresponds to a range of angles exceeding 45 degrees.

Some embodiments of the present patient-support apparatuses comprise: a frame having a seat portion and a back portion configured to pivot between a lowered position and a raised position; an air mattress having one or more back chambers, and one or more seat chambers; a fluid source coupled to the one or more seat chambers; a sensor configured to detect if the angle of the back portion of the frame is being adjusted; and a controller coupled to the sensor and configured such that if the sensor detects that the back portion of the frame is being adjusted, the controller will isolate the one or more seat chambers until the back portion stops being adjusted. Some embodiments further comprise: one or more valves configured to isolate the one or more seat chambers from the one or more back chambers; where the controller is coupled to the one or more valves, and the controller is further configured to activate the one or more valves to isolate the one or more seat chambers from the one or more back chambers if the sensor detects that the angle of the back portion is being adjusted.

Some embodiments of the present patient-support apparatuses comprise: a frame having a head end, a foot end, and a mattress region between the head end and the foot end, the frame including a coupling portion; a housing coupled to the frame and having a peripheral edge facing the mattress region of the frame, the housing supporting at least one of a fluid source and a controller; a boundary member having a first side, a second side, and a lip extending from the second side; where the boundary member is configured to be removably coupled to the coupling portion of the frame such that the first side of the boundary member faces the mattress region, the second side of the boundary member faces the housing, and the lip of the boundary member extends over the upper peripheral edge of the housing. In some embodiments, the boundary member is configured to be removably coupled to the frame such that if a mattress is supported in the mattress region, the boundary member extends above at least a portion of an upper boundary of the mattress. In some embodiments, the boundary member comprises a footboard. In some embodiments, the boundary member comprises a siderail.

Any embodiment of any of the present devices and kits can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

FIGS. 6A-6C depict a flowchart depicting another embodiment of the present methods.

DESCRIPTION OF ILLUSTRATIVE EMBODIMENTS

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device or kit that "comprises," "has," "includes" or "contains" one or more elements possesses those one or more elements, but is not limited to possessing only those elements. Likewise, a method that "comprises," "has,"

"includes" or "contains" one or more steps possesses those one or more steps, but is not limited to possessing only those one or more steps.

Further, a device or system that is configured in a certain way is configured in at least that way, but it can also be configured in other ways than those specifically described.

Figure 1:
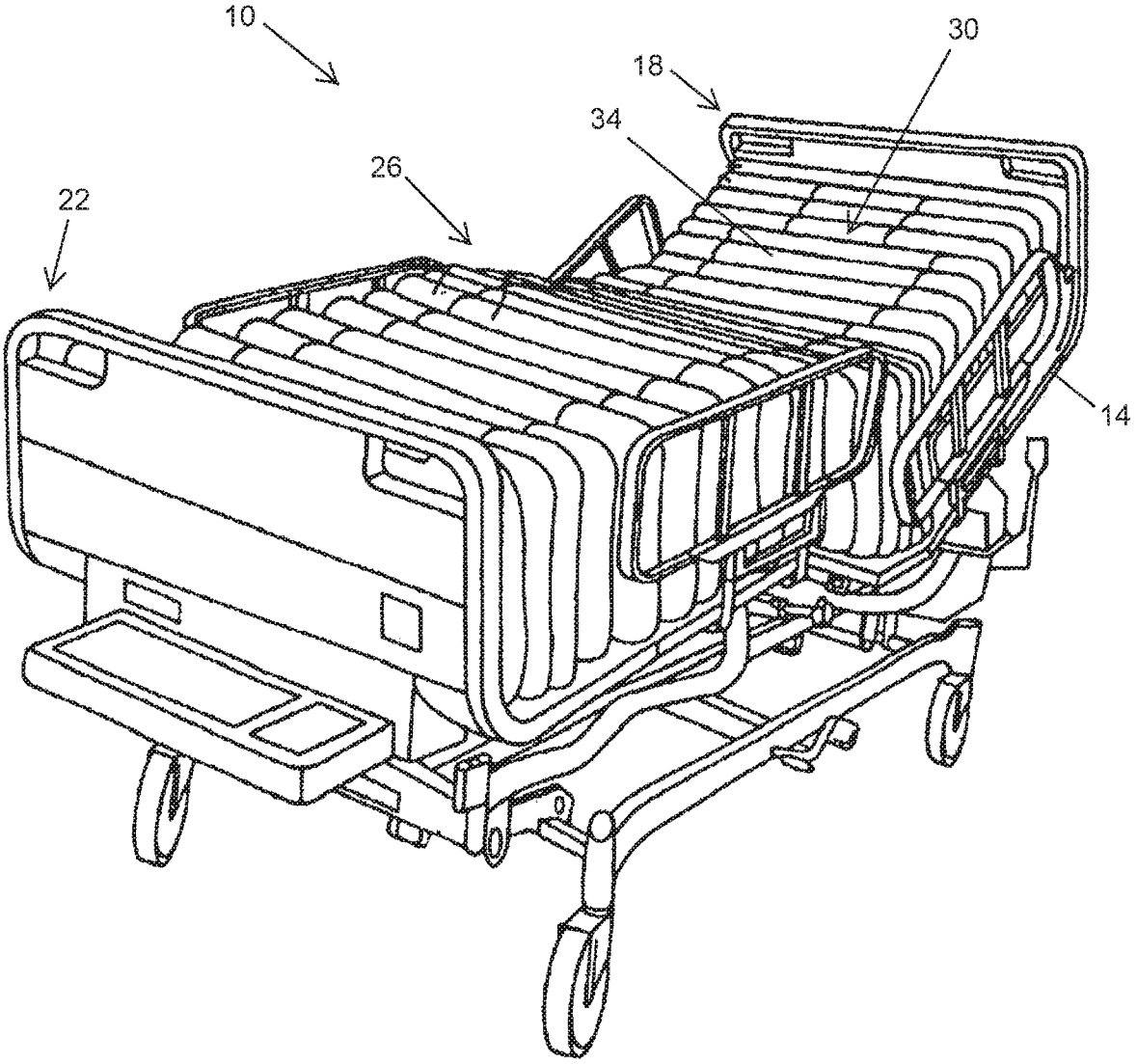
FIG. 1 depicts a perspective view of an example of a patient support apparatus with which certain embodiments of the present control units and methods may be implemented.

Referring now to the drawings, and more particularly to FIG. 1, shown therein and designated by the reference numeral 10 is a patient-support apparatus or bed with which the present features may be implemented individually or in any suitable combination. In the embodiment shown, apparatus 10 comprises a frame 14 having a head end 18, a foot end 22, and a mattress region 26 between head end 18 and foot end 22. As shown, mattress region 26 is configured to support (and is shown supporting) a mattress 30. In the embodiment shown, mattress 30 includes two or more zones (e.g., a head zone, a shoulder zone, a body zone, a leg zone, etc.), each of which comprises one or more inflatable chambers 34.

Figure 2A:
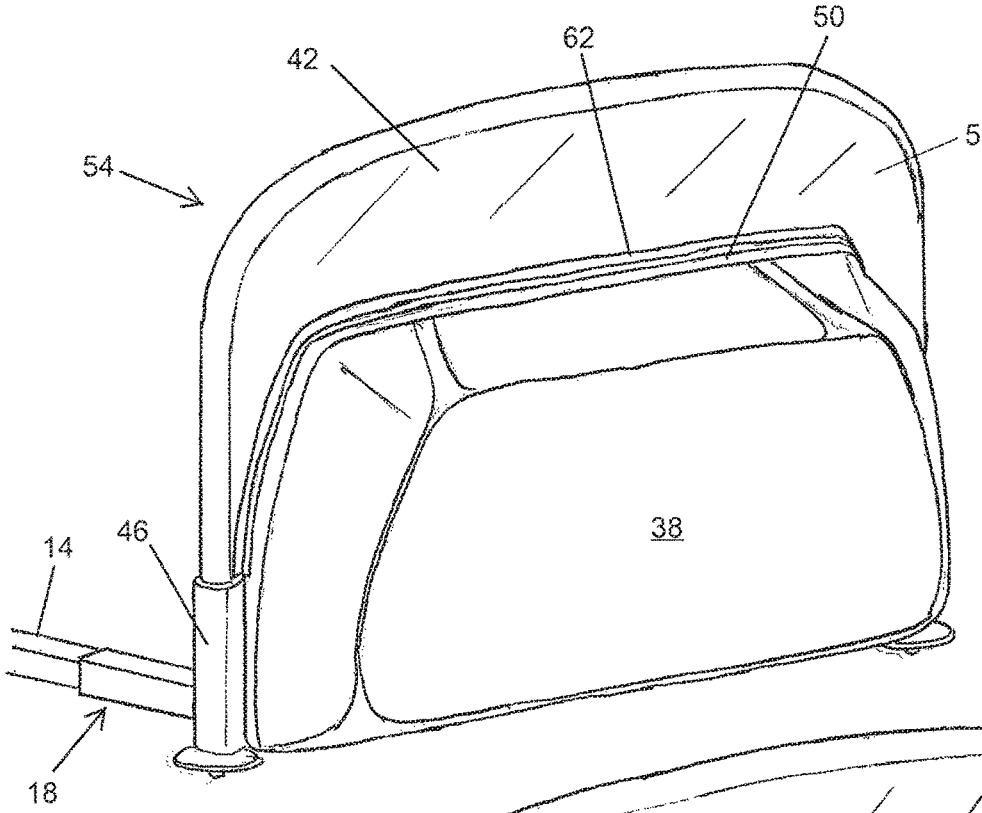
FIGS. 2A and 2B depict perspective views of one embodiment of the present apparatuses including a housing and a removable boundary member.
Figure 2B:
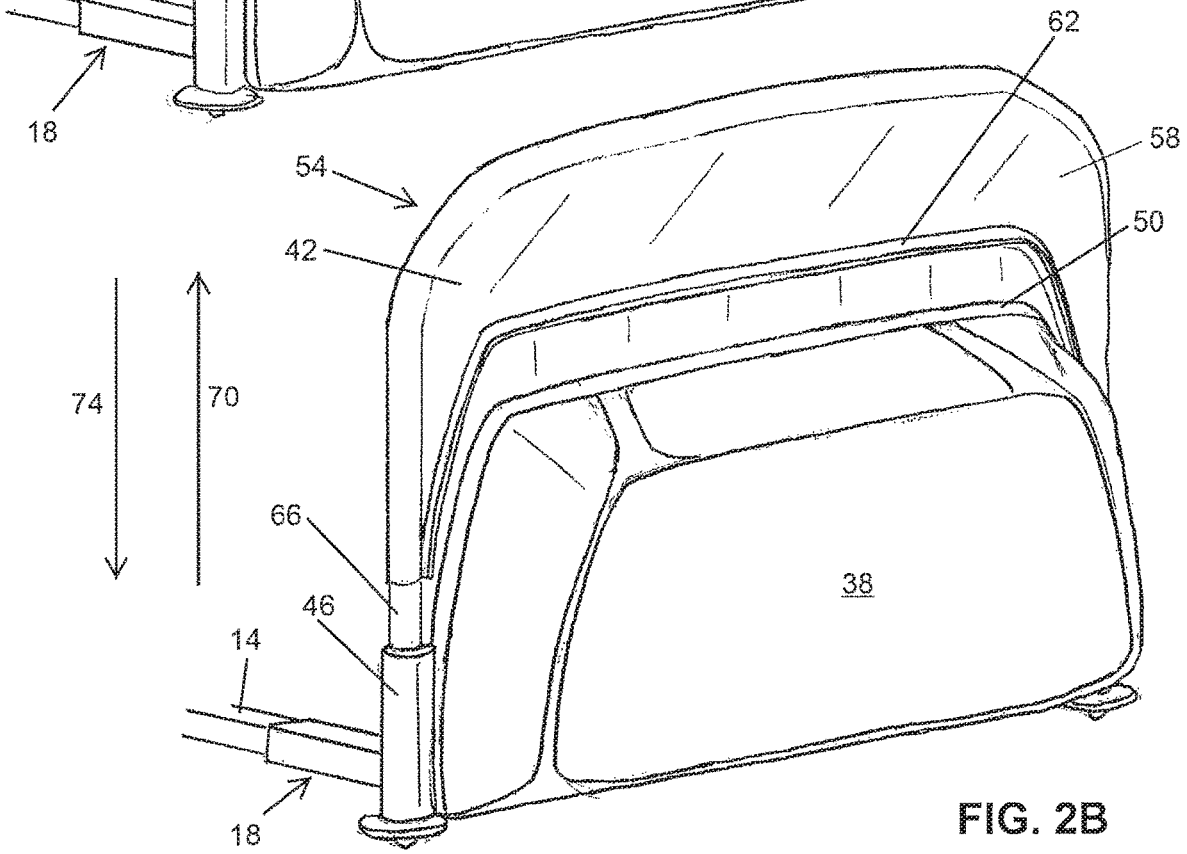
Figure 2C:
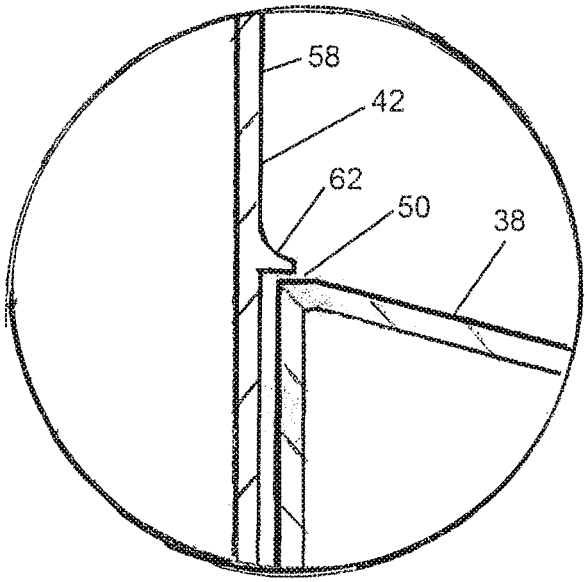
FIG. 2C depicts an enlarged cross-sectional view of a portion of the apparatus of FIGS. 2A and 2B.

FIGS. 2A and 2B depict perspective views of a portion of one embodiment of the present apparatuses 10*a* including a housing 38 and a removable boundary member 42. In the embodiment shown, frame 14 (e.g., foot end 22 of frame 14) includes a coupling portion 46. In the embodiment shown, housing 38 is coupled to frame 14 (e.g., to foot end 22) and having a peripheral edge 50 facing mattress region 26 of frame 14. As described additionally below, housing 38 can support and/or house at least one of a fluid source (e.g., 120*a* of FIG. 3) and/or a controller (e.g., 136 of FIG. 3). In the embodiment shown, boundary member 42 includes a first side 54, a second side 58, and a lip 62 extending from second side 58. As shown, boundary member 42 is configured to be removably coupled to coupling portion 46 of frame 14 such that first side 54 of boundary member 42 faces mattress region 26, second side 58 of boundary member 42 faces housing 38, and lip 62 of boundary member 42 extends over upper peripheral edge 50 of housing 38 (as is shown in detail in FIG. 2C).

In the embodiment shown, boundary member 42 comprises coupling portions 66 (e.g., round cylindrical portions) configured to be received in correspondingly shaped openings in coupling portions 46, such that boundary member 42 can be removed from frame 14 (as is partially shown in FIG. 2B) by lifting or pulling boundary member 42 in an upward direction 70, and such that boundary member 42 can be coupled to frame 14 by aligning coupling portions 66 with coupling portions 46 and lowering boundary member 42 in a downward direction 74.

In the embodiment shown, boundary member 42 is configured to be removably coupled to frame 14 such that if a mattress 30 is supported in mattress region 26, boundary member (e.g., the uppermost surface of edge of boundary member 42) extends above at least a portion of an upper boundary (e.g., the top of) of the mattress. In the embodiment shown, boundary member 42 comprises a footboard (e.g., is coupled to foot end 22 of frame 14). In other embodiments, the boundary member can comprise a siderail.

Figure 3:
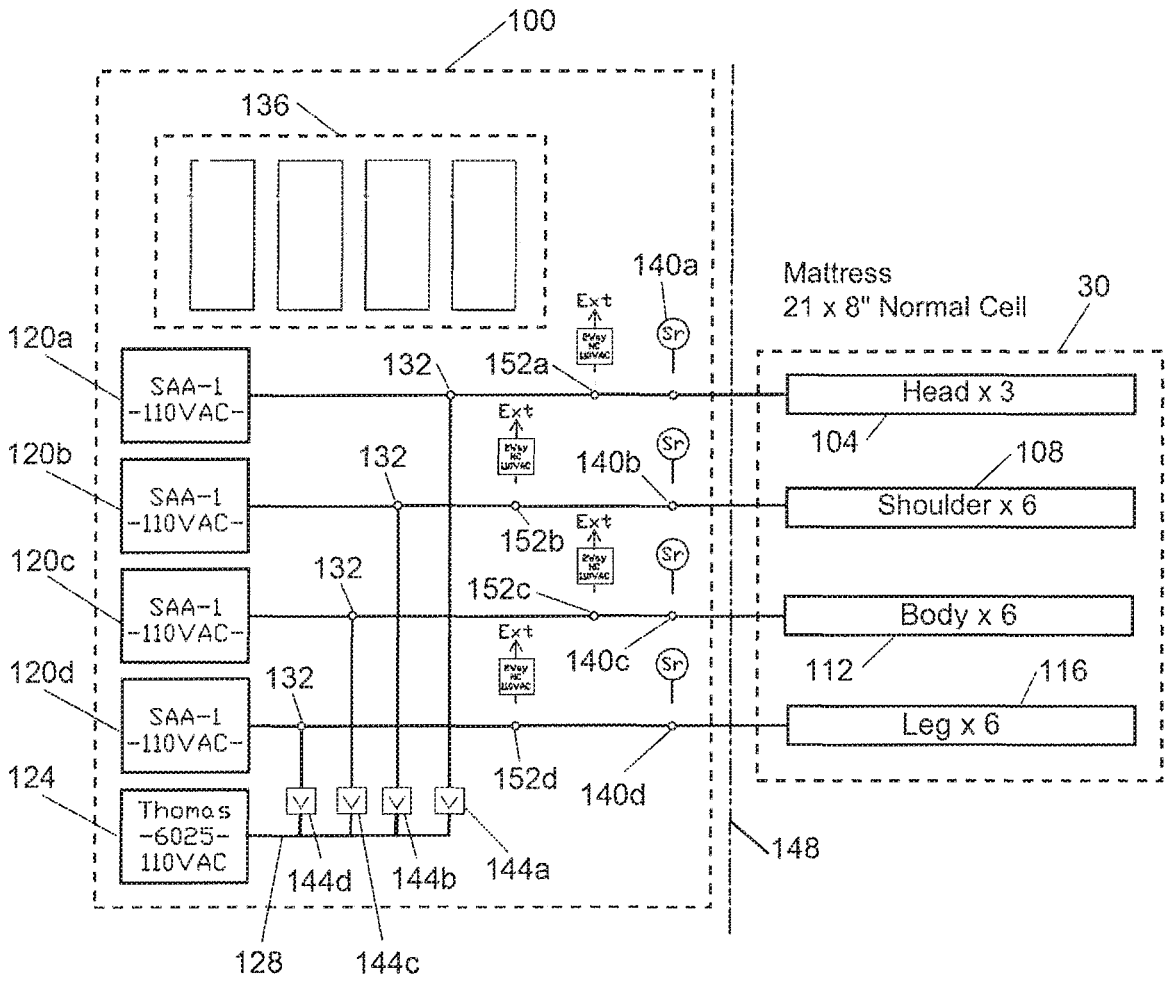
FIG. 3 depicts a block diagram of one embodiment of the present patient-support apparatuses.

FIG. 3 depicts a block diagram of one embodiment of the present patient-support apparatuses 10. In the embodiment shown, apparatus 10 comprises a control unit 100 and a mattress 30 with two or more inflatable zones. More particularly, mattress 30 includes a head zone 104, a shoulder zone 108, a body zone 112, and a leg zone 116. In the embodiment shown, control unit 100 includes two or more (e.g., four) primary fluid sources 120*a*, 120*b*, 120*c*, 120*d* each having a first capacity and coupled to a corresponding one of the two or more inflatable zones 104, 108, 112, 116. For example, as shown, primary fluid source 120*a* is coupled to head zone 104, primary fluid source 120*b* is coupled to shoulder zone 108, primary fluid source 120*c* is coupled to body zone 112, and primary fluid source 120*d* is coupled to leg zone 116. In the embodiment shown, primary fluid sources are substantially similar to one another (e.g., each may be the same model pump from the same manufacturer, may have the same flowrate, head rating, or other capacity). For example, some embodiments of suitable air pumps and/or compressors are available from the Thomas Division of Gardner Denver Thomas (Sheboygan, Wis., USA). In the embodiment shown, primary fluid sources 120*a*, 120*b*, 120*c*, 120*d* are standard pumps or compressors that are used in certain patient-support apparatuses, such as, for example, those available from Kinetic Concepts Inc. (San Antonio, Tex., USA).

In the embodiment shown, apparatus 10 (e.g., control unit 100) also comprises a secondary fluid source 124 having a second capacity that is greater than the first capacity of each primary fluid source 120*a*, 120*b*, 120*c*, 120*d*. Fluid source capacity may be measured and/or rated in flowrate (e.g., liters per minute (L/m), cubic feet per minute (cfm or $ft^3$/min), cubic inches per minute ($in^3$/min), cubic centimeters per minute ($cm^3$/min)), pressure, and/or any other suitable indicator of capacity of fluid delivery. In the embodiment shown, the secondary fluid source and the primary fluid sources share a common housing (e.g., housing 38 of FIGS. 2A-2C). In other embodiments, the primary fluid sources and the secondary fluid source may be disposed or housed in separate housings, and/or may include two or more secondary fluid sources. In the embodiment shown, secondary fluid source 124 is coupled to (each of) the two or more inflatable zones (head zone 104, shoulder zone 108, body zone 112, leg zone 116), such as, for example, by way of tubing 128 and tee fittings 132. Secondary fluid source 124 can be an air compressor or pump. In some embodiments, secondary fluid source 124 can have a capacity (e.g., max flowrate, head rating, etc.) that is larger than (e.g., equal to, greater than, or between, any of: 125, 150, 200, 400, 500, 600, 700, 800, 900, 1000, or more percent of) the corresponding capacity of any individual one of the primary fluid sources. One example of a suitable secondary fluid source is the 6025 series pump available from the Thomas Division of Gardner Denver Thomas (Sheboygan, Wis., USA).

In the embodiment shown, apparatus 10 (e.g., control unit 100) also comprises a controller 136 coupled to primary fluid sources 120*a*, 120*b*, 120*c*, 120*d* and to secondary fluid source 124. More particularly, in the embodiment shown, controller 136 is configured to activate secondary fluid source 124 to provide fluid to the zones of mattress 30 if the pressure in at least one (e.g., all) of zones 104-116 is below a lower threshold pressure (e.g., the lowest expected operating pressure in the zones). For example, in some embodiments, each zone may be expected to operate at a pressure between 8 and 20 inches of water (inches $H_2O$). If the pressure in any one or more of the zones is or falls below the lower threshold pressure of 8 inches $H_2O$, controller 136 can be configured to activate secondary fluid source 124 to provide fluid to at least the zones that are below the lower threshold pressure (e.g., at least until all zones are above their respective lower threshold pressures). For example, in some embodiments, one or more of valves 152*a*, 152*b*, 152*c*, 152*d* may be closed for any zones above the threshold pressure, at least until all zones are above the threshold pressure. In some embodiments, the lower threshold pressures of the zones may be identical. In other embodiments, different zones may have different threshold pressures, such as, for example, as is described in this disclosure for various embodiments of the present methods (e.g., with references to FIGS. 5 and 6A-6C). Controller 136 can comprise any suitable structure or device capable of being programmed or otherwise configured to function as described for any one or combination of the functions described in this disclosure. For example, controller 136 can comprise one or more microcontrollers, processors, CPUs, field-processing gate arrays (FPGAs), and/or any combination thereof. Controller 136 may include volatile and/or non-volatile memory as appropriate for memory functions included within various embodiments of the present controllers, apparatuses, and/or control units.

In the embodiment shown, apparatus 10 (e.g., control unit 100) comprises sensors 140*a*, 140*b*, 140*c*, 140*d* configured to measure the pressure in the zones of mattress 30. More particularly, as shown, sensor 140*a* is configured to measure the pressure in head zone 104, sensor 140*b* is configured to measure the pressure in shoulder zone 108, sensor 140*c* is configured to measure the pressure in body zone 112, and sensor 140*d* is configured to measure the pressure in foot zone 116. In the embodiment shown, controller 136 is configured to receive signals from the sensors indicative of the pressure in the zones of the mattress 30, such that, for example, controller 136 can determine whether the pressure in any one of (and/or all of) the zones is at, below, or above a lower threshold pressure for each zone.

In the embodiment shown, controller 136 is configured to deactivate secondary fluid source 124 when pressure in each of the zones of mattress 30 reaches or exceeds the lower threshold pressure (e.g., exceeds the lower threshold pressure by an incremental amount (e.g., 1, 2, 3, or more inches $H_2O$). In some embodiments, controller 136 is also configured to activate each of primary fluid sources 120*a*, 120*b*, 120*c*, 120*d* to provide fluid to the corresponding zones (104, 108, 112, 116) if the pressure in the corresponding zone is below a target pressure (e.g., a target pressure for all of the zones or a target pressure that is specific to a certain zone).

In the embodiment shown, apparatus 10 (e.g., control unit 100) comprises check valves 144*a*, 144*b*, 144*c*, 144*d* disposed between secondary fluid source 124 and zones 104, 108, 112, 116 of mattress 30 such that the check valves permit fluid (e.g., air) to flow through the check valves away from secondary fluid source 124, and substantially prevent fluid from flowing through the check valves toward secondary fluid source 124. As such, in the embodiment shown, apparatus 10 (e.g., control unit 100) is configured such that secondary fluid source can add fluid to the system, but cannot remove or permit fluid to escape from the system.

In some embodiments, the check valves are configured such that secondary fluid source will supply fluid to zones at a lower pressure before supplying fluid to zones with a higher pressure. For example, the check valves can be configured such that if zone 104 is at 5 inches $H_2O$, and zones 108, 112, and 116 are at 7 inches $H_2O$, fluid (e.g., air) from secondary fluid source 124 will be supplied to zone 104 until zone 104 reaches 7 inches $H_2O$ (e.g., the pressure equalizes across all four zones), at which time fluid will be added to all four zones substantially equally until all four zones reach the minimum threshold pressure among the four zones. For example, where zone 104 has a minimum threshold pressure of 8 inches $H_2O$, and zones 108, 112, 116 each have a minimum threshold pressure of 10 inches $H_2O$, all four zones will receive fluid from secondary fluid source at a substantially constant rate until all four zones reach 8 inches $H_2O$. In some embodiments, controller 136 is configured to then deactivate secondary fluid source 124 and allow primary fluid sources 120*b*, 120*c*, 120*d* to supply fluid to zones 108, 112, 116 until the minimum threshold pressure is reached. In other embodiments, controller 136 is configured to isolate zone 104 (e.g., via a valve or the like, as described in more detail below), and continue to supply fluid from secondary fluid source 124 until zones 108, 112, 116 reach their respective minimum threshold pressure.

In some embodiments, control unit 100 is removable from apparatus 10. For example, in some embodiments, the primary fluid sources are configured to be removably coupled to the zones of mattress 30 by way of a connection interface (e.g., manifold, connector, etc.) 148. For example, where control unit 100 is disposed in or supported by housing 38, mattress 30 may be removably coupled to control unit 100 such that mattress can be removed and/or replaced from apparatus 10. In such embodiments, secondary fluid source can be configured to be coupled to each of the zones of the mattress as well. For example, and as shown in FIG. 3, secondary fluid source 124 can be coupled to primary fluid sources 120*a*, 120*b*, 120*c*, 120*d* by way of tubing 128 and tee fittings 132 (e.g., within housing 138). In such embodiments, controller 136 can be configured such that if the primary fluid sources and the secondary fluid source are coupled to the zones of a mattress, the controller will activate the secondary fluid source to provide fluid to the two or more zones if the pressure in at least one of the two or more zones is below a lower threshold pressure.

Control unit 100 may be suitable, for example, for use with or in patient-support apparatuses with rapid-deflation mechanisms for performing CPR. With systems known in the art, after a CPR deflation of the air mattress, it may take up to 30 minutes to re-inflate the mattress to a minimum expected operating pressure (e.g., greater than, equal to, or between, any of: 4, 5, 6, 7, 8, 9, 10, 15, 20, 25, 30, or more inches $H_2O$). However, control unit 100 with secondary fluid source 124 can be configured to inflate a mattress from a post-CPR-deflation or fully deflated state to the minimum expected operating pressure in a time period of less than, equal to, or between, any of: 0.5, 1, 2, 3, 4, 5, 6, 7, 8, 9, or 10 minutes, significantly reducing the amount of time required to return a patient to a comfortably and safely supported state. Additionally, control unit 100 is configured to provide a backup for punctures or leaks in a zone by providing a high-capacity secondary fluid source that can maintain a functional pressure and/or inflation in a zone until a leak can be repaired.

In the embodiment shown, apparatus 10 (e.g., control unit 100) includes valves 152*a*, 152*b*, 152*c*, 152*d* configured to be capable of isolating individual zones of mattress 30 if control unit 100 is coupled to mattress 30, as shown. More particularly, in the embodiment shown, valve 152*a* is disposed between fluid source 120*a* and sensor 140*a* such that if valve 152*a* is closed, zone 104 is isolated such that sensor 140*a* can detect the pressure in zone 104. Valves 152*b*, 152*c*, 152*d* are similarly configured for zones 108, 112, 116, respectively. Thus, valves 152*a*, 152*b*, 152*c*, and/or 152*d* can be closed to isolate individual zones of the mattress to prevent air from escaping from a zone. For example, if the pressure on a zone (e.g., under the seat of a patient) is increased or is expected to increase (e.g., if the patient sits up, or the incline of the back of the bed is raised), valve 152*c* can be closed to prevent or reduce sagging in zone 112.

Figure 4A:
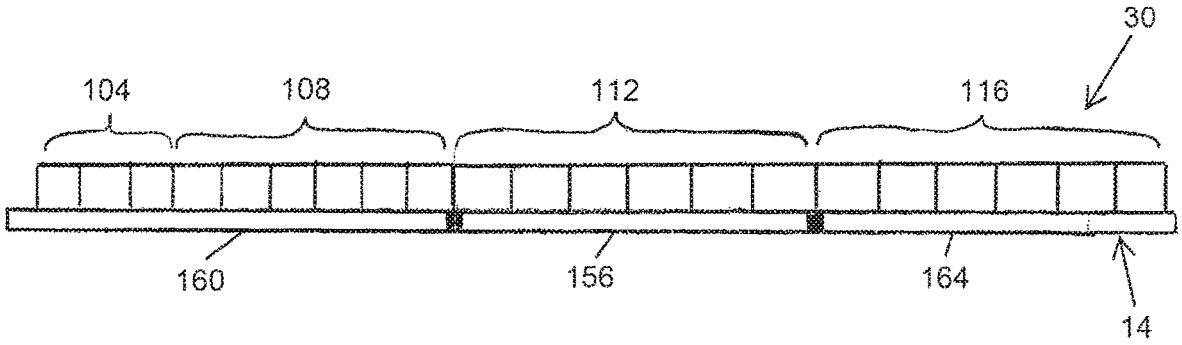
FIG. 4A-4C depict side views of an articulable frame supporting a multi-chamber inflatable mattress suitable for use with the apparatus of FIG. 3 in various configurations.
Figure 4B:
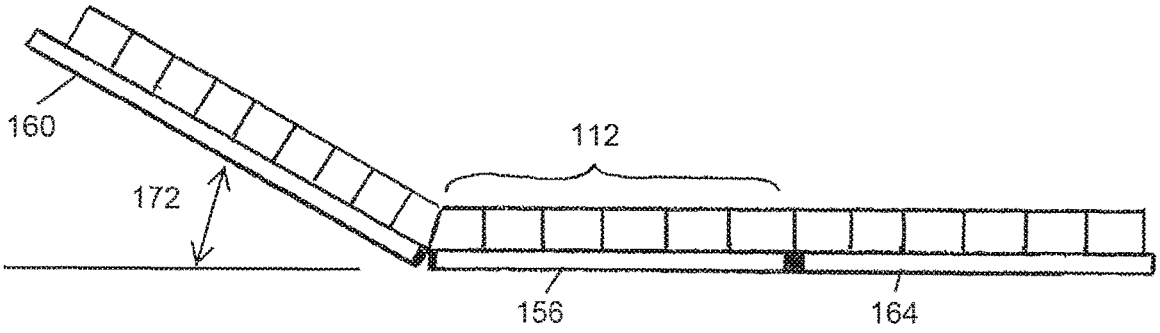
Figure 4C:
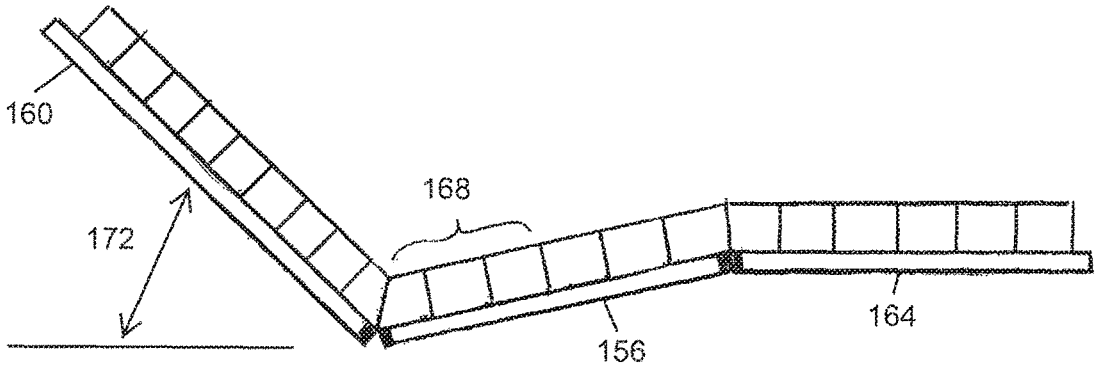

FIGS. 4A-4C depict side views of an example of frame 14 and mattress 30 that are suitable for use with or in certain embodiments of the present apparatuses (e.g., 10) and/or the present methods. In the embodiment shown, frame 14 includes a seat portion 156 and a back portion (or fowler)

160 configured to pivot (e.g., relative to seat portion 156) between a lowered position (e.g., FIG. 4A) and a raised position (e.g., FIG. 4C). In the embodiment shown, frame 14 further comprises a leg portion 164 configured to pivot (e.g., relative to seat portion 156). As described above with reference to FIG. 3, mattress 30 is an air mattress having two or more zones. Each of zones 104, 108, 112, and 116 includes one or more inflatable chambers 34, such that mattress 30 includes one or more back chambers (in shoulder zone 108) and one or more seat chambers (in body zone 112). In some embodiments, the one or more seat chambers are within a seat zone that is coextensive with body zone 112, or the seat zone may includes a subset 168 of the chambers in body zone 112 (and/or in shoulder zone 108). As shown in FIGS. 3B and 3C, frame 14 is configured such that back portion 160 (or fowler 160) can be pivoted relative to seat portion, such that angle (e.g., fowler angle FA or $F_A$) 172 of fowler 160 can vary between a lower bound (e.g., zero (0) degrees) as shown in FIG. 4A, and an upper bound (e.g., 75 degrees). Although mattress 30 is described with four zones, other embodiments of mattress 30 may include any suitable number of zones (e.g., two, three, five, six, seven, eight, nine, or more).

If angle 172 is increased, such as is shown in FIGS. 4B and 4C, when a patient is lying on mattress 30, the weight of the patient's upper body may be gradually transferred to the seat zone (e.g., body zone 112) of mattress 30 such that greater force is imparted on the seat zone of the mattress by the patient's seat or buttocks. If controller 132 maintains the same target pressure for body zone 112 as was present when back portion 160 was flat (as in FIG. 4A), then the increased force will cause the seat zone of the mattress to compress and may result in an uncomfortable condition for the patient.

Figure 5:
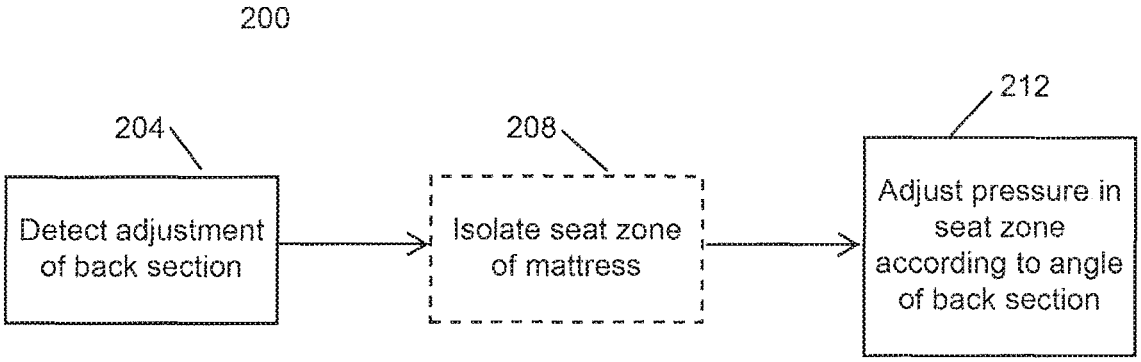
FIG. 5 depicts a flowchart of some embodiments of the present methods.

FIG. 5 depicts a flowchart of one of the present methods 200 for compensating or preventing discomfort to the patient. In the embodiment shown, method 200 includes a step 204 in which the fowler angle (e.g., 172) of back portion or fowler 160 is detected. In the embodiment shown, method 200 further comprises a step 208 in which the seat zone (e.g., chambers in body zone 112) of mattress 30 is isolated (e.g., prior to step 208) until the angle of the back portion stops being adjusted. In the embodiment shown, method 200 further comprises a step 212 in which the pressure is adjusted in the seat zone of the mattress according to the angle (172) of back portion 160, if the angle (172) exceeds a threshold angle. As used in this disclosure, "isolating" includes preventing fluid from escaping the isolated zone(s) or chamber(s). Without isolating the seat zone, air would be allowed to escape to compensate for the added weight by returning seat zone to the pressure that preceded the increase in angle 172.

Some embodiments of the present apparatuses and control units are configured to implement one or more embodiments of method 200. For example, some embodiments of apparatus 10 (of FIG. 3) include frame 14. Some embodiments further comprise a sensor (not shown but such as, for example, an accelerometer or any other suitable sensor coupled to controller 132) configured to detect if the angle of a pivotable back section of a patient support is changing (e.g., if the angle of back section 160 is being adjusted). In some embodiments, controller 132 is configured to isolate (e.g., by closing valve 152*c* to prevent air from escaping) the seat zone (e.g., the chambers in the seat zone) of mattress 30 until angle 172 stops changing (e.g., instantaneously or for a predetermined period of time, such as, for example, at least, equal to, or between any of 0.05, 0.1, 0.2, 0.3, 0.4, 0.5, 0.6, 0.7, 0.8, 0.9, 1, or more seconds). In such embodiments, the sensor and/or another sensor (not shown, but such as, for example, an electronic angular position sensor) can be configured to detect the angle of back portion or fowler 160 of frame 14 (e.g., after adjustment of angle 172 has stopped). In some embodiments, controller 132 is configured to adjust the pressure in the seat zone (chambers) according to angle 172 of back portion or fowler 160 if angle 172 exceeds a threshold angle. For example, the threshold angle may be a maximum angle at which the standard angle for back portion 160 is expected to be comfortable to the patient, such as, for example, 5, 10, or 15 degrees. Controller 132 can adjust pressure in the seat zone by opening valve 152*c* to release fluid from the seat zone and/or by activating primary fluid source 120*c* (corresponding to the seat zone (e.g., body zone 112)) to increase pressure in the seat zone if angle 172 of fowler 160 exceeds the threshold angle.

Some embodiments of the present methods comprise: detecting that the angle 172 of a pivotable back section 160 of a patient support is changing; and isolating (e.g., by closing valve 152*a*) one or more seat chambers of mattress 30 until angle 172 of back section 160 stops changing. Some embodiments further comprise: receiving a signal indicative of the angle of a back section; and adjusting the pressure in the one or more seat chambers (e.g., chambers 34 in body zone 112) if angle 172 of the back section exceeds a threshold angle (e.g., 15 degrees). Adjusting the pressure can comprise, for example, activating one or more fluid sources (e.g., 120*b*) to increase the pressure in one or more seat chambers, and/or releasing fluid (e.g., air) from the one or more seat chambers to decrease the pressure in the one or more seat chambers.

As described in more detail below with reference to FIGS. 6A-6C, in some embodiments, the pressure in the seat chambers is adjusted to a target pressure level that corresponds to the angle of the back section. In some embodiments, the target pressure level is selected from among a plurality of predetermined pressures each corresponding to a different range of angles of the back section (e.g., each of plurality of predetermined pressures may increase with the magnitude of the corresponding angular range). For example, in some embodiments, a first predetermined pressure corresponds to an angular range of 15-30 degrees; a second predetermined pressure corresponds to an angular range of 30-45 degrees; and a third predetermined pressure corresponds to a range of angles exceeding 45 degrees. Although the present embodiments are described with four pre-set fowler-angle ranges (<15, 15-30, 30-45, and >45 degrees), other embodiment may include any suitable number of pre-set fowler-angle ranges, such as, for example, two, three, five, six, seven, eight, nine, ten, or more. For example, other embodiments may include pre-set fowler angle ranges of <10, 10-20, 20-30, 30-40, 40-50, and >50 degrees). In some embodiments, there need not be any pre-set fowler-angle ranges (e.g., the controller can be configured to calculate the desired pressure for any individual angle without first determining a range within which the fowler angle falls), such as, for example, by skipping from step 344 directly to step 376 in FIG. 6B.

Figure 6A:
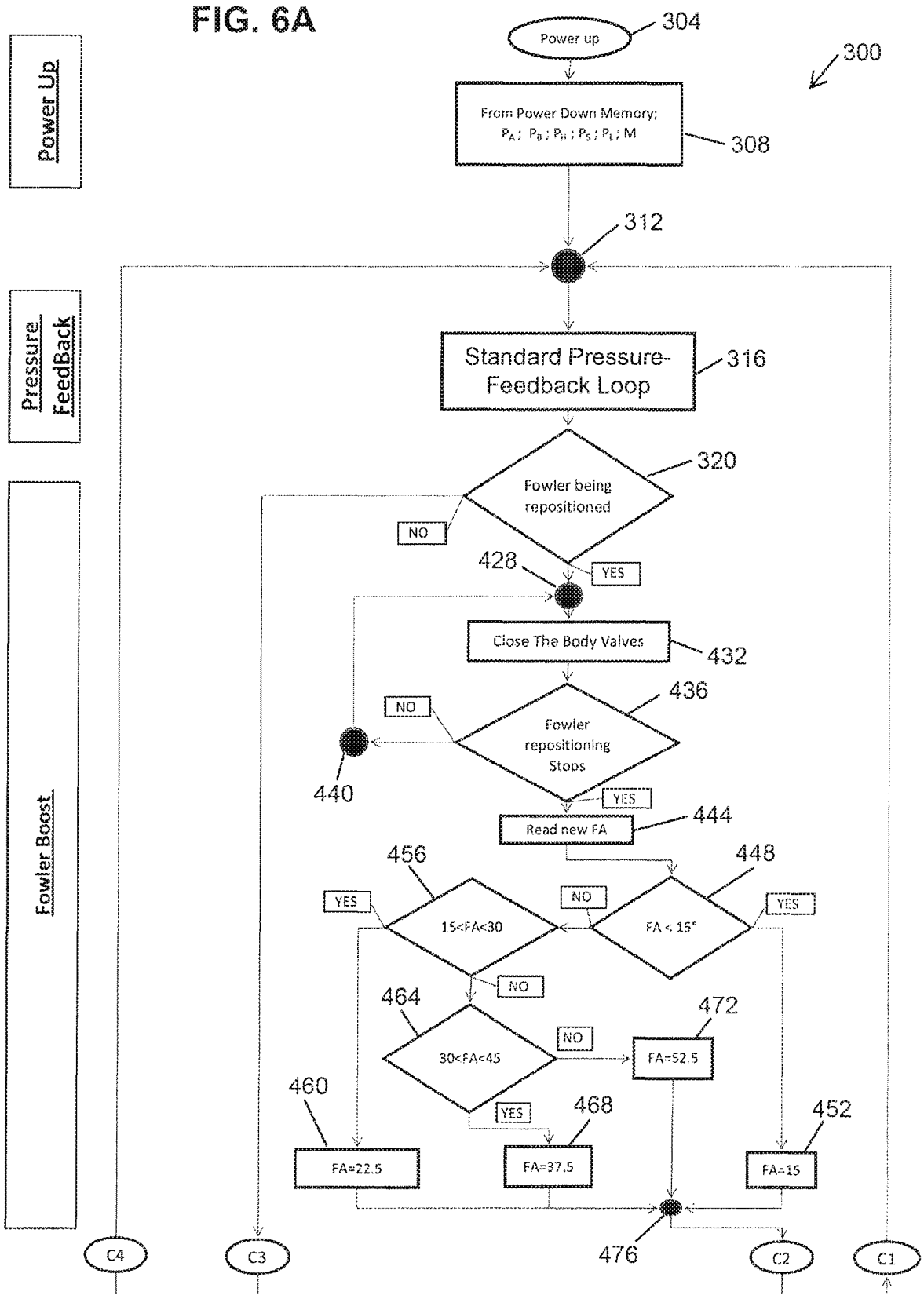
Figure 6C:
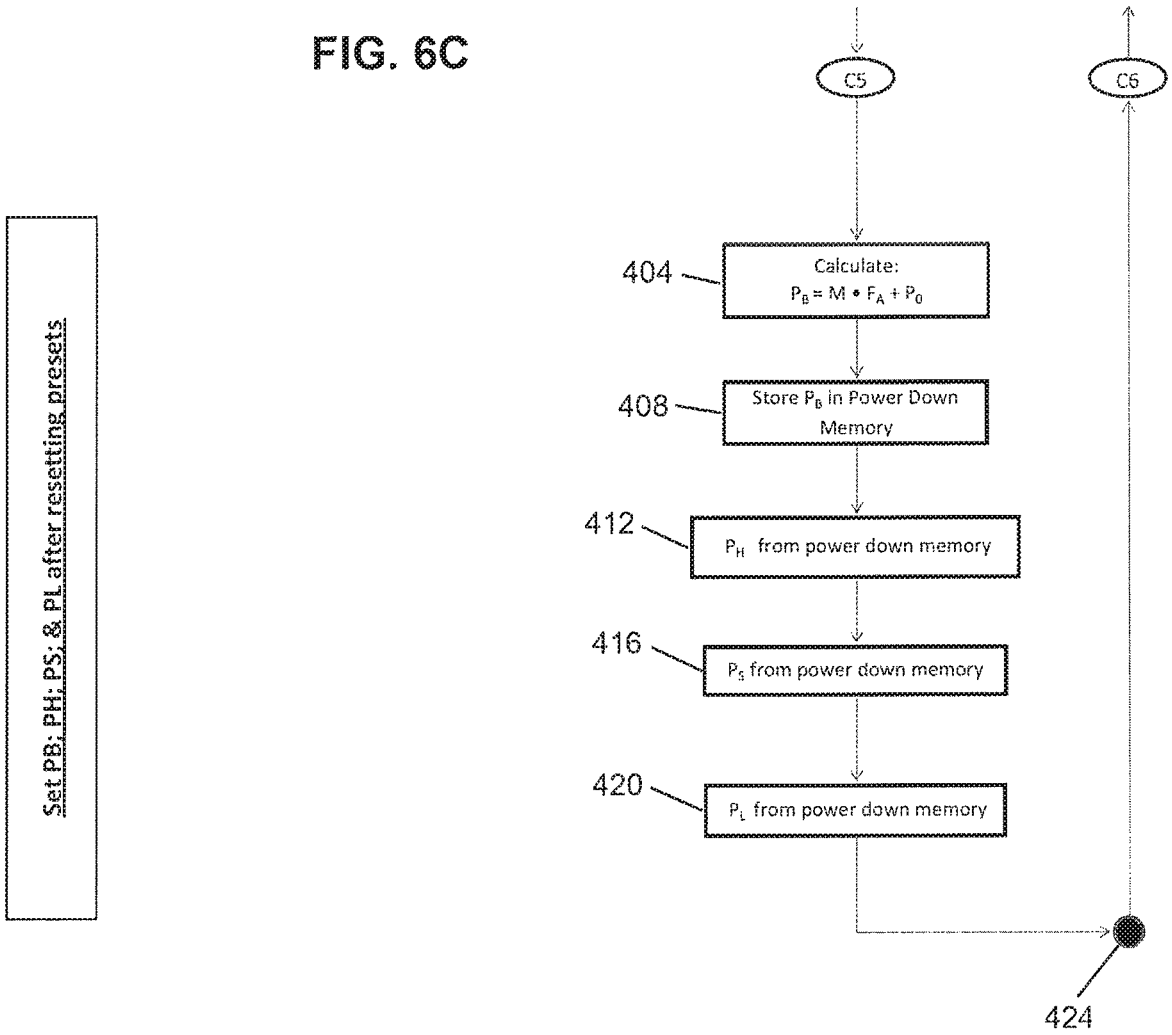
Figure 7:
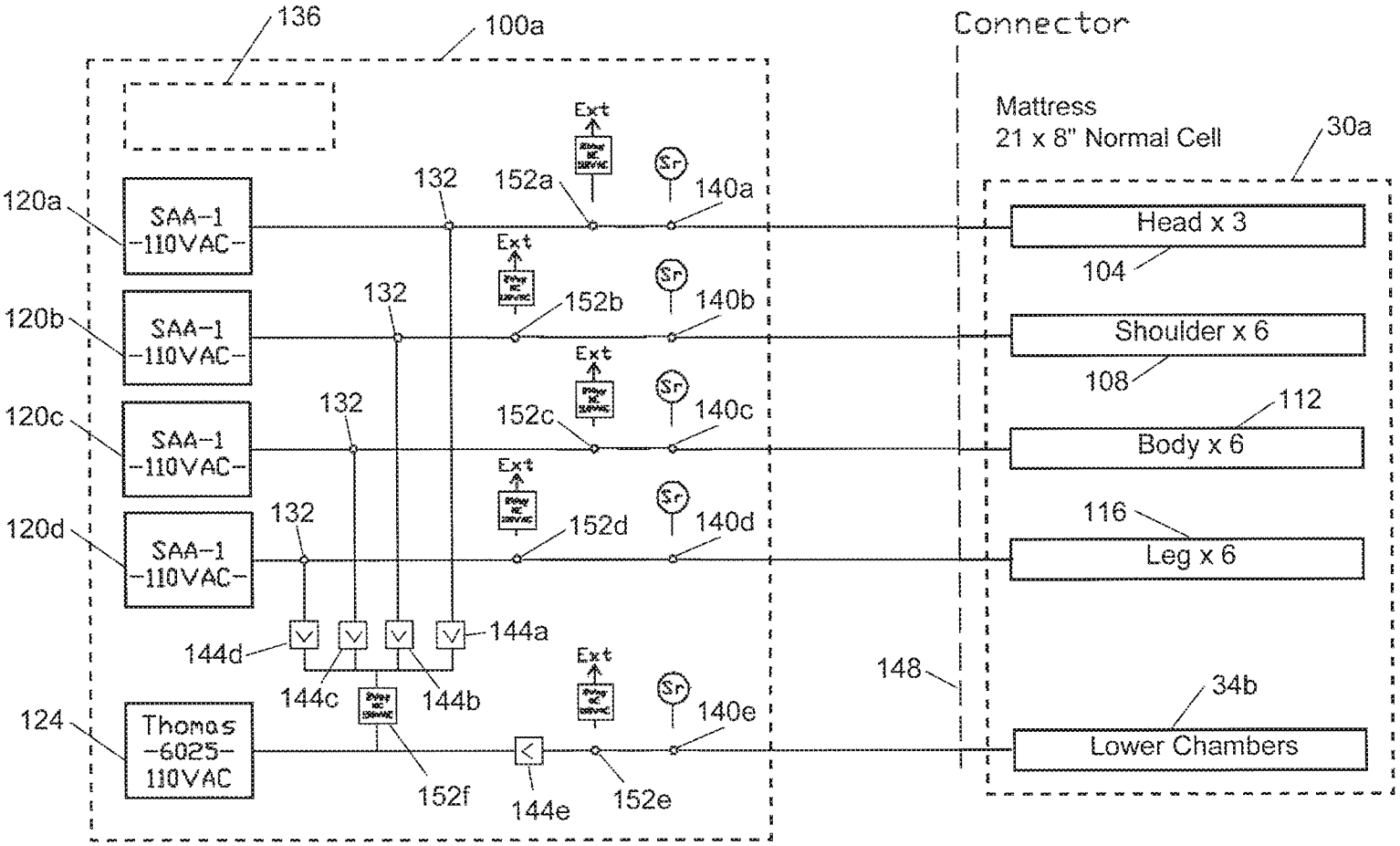
FIG. 7 depicts a block diagram of another embodiment of the present patient-support apparatuses.

FIGS. 6A-6C depict a more-detailed flowchart of one embodiment 300 of a control scheme or method implementing the present methods with control unit 100. For brevity, several values in FIGS. 6A-6C are denoted by abbreviations, as listed in Table 1.

TABLE 1

| Key for Flowchart of FIGS. 6A-6C | |
|---|---|
| $P_A$ | Body Target Pressure in Body Zone 112 for Range A ($F_A$ = 15) |
| $P_B$ | Body Target Pressure in Body Zone 112 |
| $P_H$ | Head Target Pressure in Head Zone 104 |
| $P_S$ | Shoulder Target Pressure in Shoulder Zone 108 |
| $P_L$ | Leg Target Pressure in Leg Zone 116 |
| $F_A$ | Fowler Angle 172: 0-15°, $F_A$ = 15°; 15-30°, $F_A$ = 22.5°; 30-45°, $F_A$ = 37.5°; 45-66°, $F_A$ = 52.5° |
| $P_{BR}$ | Body Pressure Reading detected in Body Zone 112 |
| $P_{HR}$ | Head Pressure Reading detected in Head Zone 104 |
| $P_{SR}$ | Shoulder Pressure Reading detected in Shoulder Zone 108 |
| $P_{LR}$ | Leg Pressure Reading detected in Leg Zone 116 |
| $P_O$ | Est. Pressure in Body Zone 112 for $F_A$ = 0 (calculations based on readings > 15°) |

Method 300 may be implemented with, and is described for use with or in, an apparatus 10 comprising frame 14. In the embodiment shown, controller 132 begins at a step 304 in which controller 132 is powered on, and proceeds to a step 308 in which initial values are obtained or read (from a power-down or nonvolatile memory coupled to or integral with controller 132) for $P_A$, $P_B$, $P_H$, $P_S$, $P_L$, and M. M is a dimensionless factor, and its calculation is described below. Controller 132 then proceeds to an optional step 316 in which a standard pressure feedback loop begins to detect and/or adjust the pressure in the zones of mattress 30. For example, a standard pressure feedback loop beginning at 316 may include a factory feedback loop (e.g., as may be included by a bed manufacturer, such as, for example, where the present control system or method based on back-section angle is added to an existing bed). In the embodiment shown, controller 132 then proceeds to step 320 in which controller 132 checks to determine whether the back portion or fowler 160 (e.g., angle 172) is being adjusted or repositioned. If back portion 160 is not being adjusted, controller 132 proceeds to a step 324 in which controller 132 checks to see whether the apparatus in an automatic adjustment mode in which the target pressures for the zones of mattress 30 are automatically adjusted. If control unit 100 is in an automatic-adjustment mode, method 300 proceeds to step 328 in which $P_A$ is set equal to $P_{BR}$, the detected pressure in body zone 112, and the current $P_A$, $P_H$, $P_S$, and $P_L$ are stored in the memory, and method 300 proceeds to point 332.

If instead control unit 100 is not in an automatic adjustment mode, controller 132 will proceed from step 324 to step 336 in which controller 132 checks to see whether the control unit 100 is configured for manual adjustment (e.g., whether the controller is in a manual-adjustment mode, such as may be selected by a user). If control unit is not in a manual-adjustment mode, then controller 132 returns to step 312. If control unit 100 is in a manual-adjustment mode, then controller 132 proceeds to step 340 in which controller 132 reads $P_{BR}$, $P_{HR}$, $P_{SR}$, and $P_{LR}$ from sensors 140*a*, 140*b*, 140*c*, 140*d*, and proceeds to point 332. From point 332, controller 132 proceeds to step 344 in which controller 132 checks angle 172 ($F_A$) of back portion 160. Controller 132 proceeds to step 348 in which controller 132 checks to see whether angle 172 is less than 15 degrees. If angle 172 is less than 15 degrees, controller 132 proceeds to step 352 in which $P_A$ is set equal to $P_{BR}$ and stored in the power-down memory. Controller 132 then proceeds to step 356 in which $F_A$ is set equal to 15 degrees, and then proceeds to step 360 in which M is calculated from Equation (1).

$$M=0.0095\,P_0+0.0852 \tag{1}$$

Controller 132 then proceeds to point 364.

If at step 348, angle 172 is greater than 15 degrees, controller 132 then proceeds to step 368 in which it is determined whether angle 172 is between 15 and 30 degrees. If angle 172 is between 15 and 30 degrees, then controller 132 proceeds to step 372 where $F_A$ is set equal to 22.5 degrees, and then proceeds to point 376. If at step 368 angle 172 is not between 15 and 30 degrees, then controller 132 proceeds to step 380 in which it is determined whether angle 172 is between 30 and 45 degrees. If angle 172 is between 30 and 45 degrees, controller 132 proceeds to step 384 in which $F_A$ is set equal to 37.5 degrees, and proceeds to point 376. If at step 380, angle 172 is not between 30 and 45 degrees, controller 132 proceeds to step 388 in which $F_A$ is set equal to 52.5 degrees, and proceeds to point 376. In other embodiments, the ranges of angles can include any suitable number or size (e.g., 5 ranges of 10 degrees each, 10 ranges of 5 degrees each, etc.).

From point 376, controller 132 proceeds to step 392 in which $P_0$ is calculated from Equation (2).

$$P_0=(P_{BR}+1.967-0.0852\cdot F_A)/(0.874+0.0095\cdot F_A) \tag{2}$$

Controller 132 then proceeds to step 396 where M is calculated from Equation (1). Controller 132 then proceeds to step 400 where $P_A$ is calculated from Equation (3), and then proceeds to point 364.

$$P_A=M\cdot F_A+P_0 \tag{3}$$

From point 364, controller 132 proceeds to step 404 in which $P_B$ is calculated from Equation (4).

$$P_B=M\cdot F_A+P_0 \tag{4}$$

Controller 132 then proceeds to step 408 in which $P_B$ is stored in the power-down memory, a step 412 in which $P_H$ is obtained from the memory, a step 416 in which $P_S$ is obtained from the memory, and a step 416 in which $P_L$ is obtained from the memory, and to point 424. Controller 132 can be configured to update or maintain the pressures in the various zones of the mattress 30 as the pressures are obtained from or checked against the memory.

Equations (1), (2), (3), and (4) were developed experimentally to approximate the relationships between various measured or detected pressures (e.g., $P_{BR}$, $P_{HR}$, $P_{SR}$, $P_{LR}$), desired or target pressures ($P_A$, $P_B$, $P_H$, $P_S$, $P_L$), and estimated of expected or estimated pressures (e.g., $P_0$) in various zones and at various stages of fowler angle (angle 172). The constants in Equations (1), (2), (3), and (4) were developed by measuring the pressure in a closed or isolated body zone (112) as the fowler angle 172 was increased. Equation (1), for example, reflects a linear approximation of the data for values of angle 172 greater than fifteen (15) degrees. The Y-axis intercept or crossing of the same data revealed a straight line defined by $B=0.874\ P_0-1.9674$, such that a reasonable approximation is given by $P_{BR}=M*F_A+B$. Combining these equations with Equation (1) yields Equation (2). This derivation is provided as an example, and in other embodiments, various other equations and/or constants can be used to correlate measured pressures in various zones (e.g., body zone 112) with target pressures in the various zones (e.g., seat zone 112), such as, for example, for various values of fowler angle 172.

From point 424, controller 132 returns to point 312 and begins to cycle through the method again. If at step 320 it is determined that back portion 160 is being repositioned (e.g., angle 172 is changing or being adjusted), controller 132 proceeds to point 428 and then to step 432 in which the seat zone (e.g., body zone 112) is isolated (e.g., by closing valve 152*c*). Controller 132 then proceeds to step 436 in which controller 132 checks to see whether back portion 160 has stopped being adjusted. If back portion 160 is still being adjusted, controller 132 proceeds to point 440, to point 428, and returns to step 432 such that the body zone of mattress 30 remains isolated until at least until back portion 160 is determined to have stopped moving at step 436. Once adjustment of back portion 160 stops, controller 132 proceeds to step 444 to determine the new $F_A$. From step 444, controller 132 proceeds to step 448 in which it is determined whether the new $F_A$ is less then 15 degrees. If the new $F_A$ is less than 15 degrees, controller 132 proceeds to step 452 in which $F_A$ is set equal to 15 degrees. If the new $F_A$ is greater than 15 degrees, controller 132 proceeds from step 448 to step 456 in which it is determined whether the new $F_A$ is between 15 and 30 degrees. If the new $F_A$ is between 15 and 30 degrees, controller 132 proceeds to step 460 in which $F_A$ is set equal to 22.5 degrees. If the new $F_A$ is not between 15 and 30 degrees, controller 132 proceeds from step 456 to step 464 in which it is determined whether $F_A$ is between 30 and 45 degrees. If the new $F_A$ is between 30 and 45 degrees, controller 132 proceeds to step 468 in which $F_A$ is set equal to 37.5 degrees. If the new $F_A$ is not between 30 and 45 degrees, controller 132 proceeds to step 472 in which $F_A$ is set equal to 52.5 degrees. Once the new $F_A$ is set, controller 132 proceeds to point 476 and then to point 364. From point 364, controller 132 proceeds through steps 404 through 420, and to point 424, as described above. As also described above, from point 424, controller 132 returns to point 312 at the beginning of the cycle.

In other embodiments, controller 132 can be configured to determine the angle of the of back portion 160 after adjustment stops and obtain a predetermined pressure value corresponding to the angle or a range within which the angle is included (e.g., 15-30 degrees). For example, predetermined pressure values can be stored in and/or obtained from a lookup table or any other suitable data structure in a power-down or nonvolatile memory in control unit 100. In other embodiments, controller can be configured to obtain a predetermined pressure factor corresponding to the angle or a range within which the angle is included (e.g., 15-30 degrees), and multiply the flat-configuration (FIG. 4A) pressure $P_B$ or $P_{BR}$ by the corresponding pressure factor. For example, if the pressure $P_B$ or $P_{BR}$ in body zone 112 is adjusted to a pressure of 10 inches $H_2O$, and a pressure factor of 1.2 corresponds to an angle 172 of 18 degrees, then the calculated $P_A$ for body zone 112 for the angle of 18 degrees would be 12 inches $H_2O$.

Figure 8A:
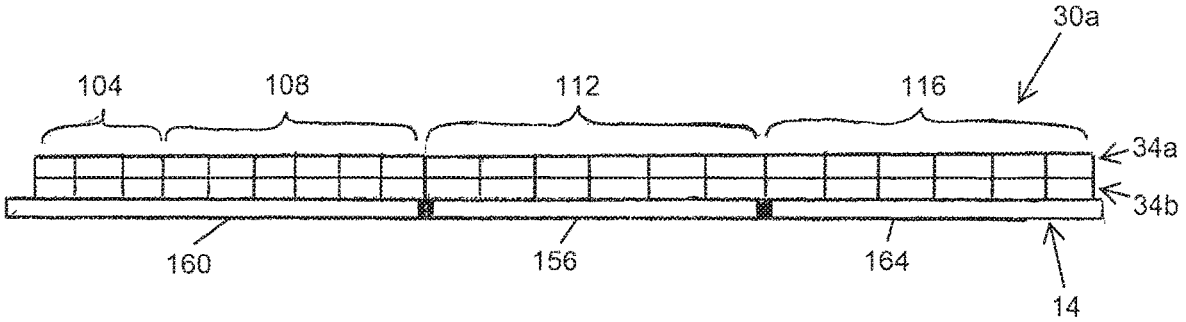
FIG. 8A-8C depict side views of an articulable frame supporting a multi-chamber inflatable mattress suitable for use with the apparatus of FIG. 7 in various configurations.
Figure 8B:
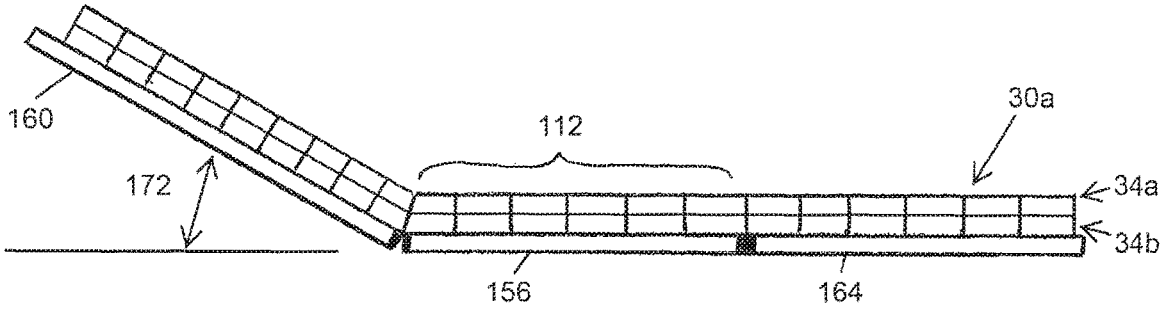
Figure 8C:
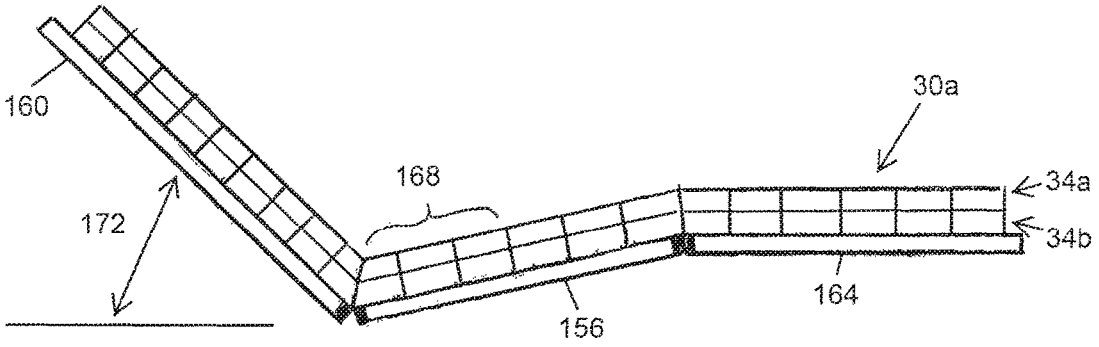

Referring now to FIGS. 7 and 8A-8C, FIG. 7 depicts a block diagram of another embodiment 10*a* of the present patient-support apparatuses; and FIGS. 8A-8C depict side views of an example of frame 14 and an alternate embodiment of mattress 30*a* that are suitable for use with or in certain embodiments of the present apparatuses (e.g., 10) and/or the present methods. Apparatus 10*a* is similar to apparatus 10, and the differences will therefore primarily be described here. Apparatus 10*a* includes mattress 30*a* that is similar to mattress 30 in that it (as shown) is an air mattress having two or more zones. Each of zones 104, 108, 112, and 116 includes one or more inflatable chambers 34, such that mattress 30 includes one or more back chambers (in shoulder zone 108) and one or more seat chambers (in body zone 112). However, in the embodiment shown, mattress 30*a* is configured such that each chamber (or bladder or segment) 34 includes an upper chamber 34*a* and a lower chamber 34*b* that is distinct from (not internally in fluid communication with) upper chamber 34*a*. In this way, mattress 30*a* includes an upper layer (comprising upper chambers 34*a*) and a lower layer (comprising lower chambers 34*b*). As such, in the embodiment shown, upper chambers 34*a* can be described as being divided into zones 104, 108, 112, and 116; and lower chambers 34*b* can be described as a continuous lower zone. In other embodiments, lower chambers 34*b* can be divided into two or more zones.

To function with mattress 30*a*, apparatus 10*a* is configured to include an additional sensor 140*e*, an additional check valve 144*e*, and an additional valve 152*e* and 152*f*. In the embodiment shown, apparatus 10*a* is configured such that upper chambers 34*a* (in head section 104, shoulder zone 108, body zone 112, and leg zone 116, respectively) are coupled to fluid sources 120*a*, 120*b*, 120*c*, 120*d*, as described above for apparatus 10, and such that lower chambers 34*b* (in all of zones 104, 108, 112, 116) are coupled to fluid source 124. More particularly, lower chambers 34*b* are fluidly in communication with one another by way of a manifold or the like (not shown), and are all coupled to fluid source 124 by way of tubing 128 and appropriate fittings. Sensor 140*e* is configured to sense the pressure within lower chambers 34*b*. Check valve 144*e* is configured to prevent the backflow of fluid (air) from lower chambers 34*b* toward fluid source 124 across check valve 144*e* (at least when mattress 34*b* is coupled to control unit 100). Valve 152*e* is disposed between fluid source 124 and sensor 140*e* such that if valve 152*a* is closed, lower chambers 34*e* are isolated such that sensor 140*e* can detect the pressure in chambers 34*e*, and such that if valve 152*e* is opened, fluid (e.g., air) can be vented or permitted to escape from lower chambers 34*b*. Additionally, apparatus 10*a* (control unit 100*a*) is configured to include a valve 152*f* that can be closed to isolate check valves 144*a*, 144*b*, 144*c*, 144*d* (and head zone 104, shoulder zone 108, body zone 112, and leg zone 116) from fluid source 124, or opened to permit fluid flow from fluid source 124 to check valves 144*a*, 144*b*, 144*c*, 144*d* (and head zone 104, shoulder zone 108, body zone 112, and leg zone 116).

In the embodiment shown, apparatus 10*a* (e.g., control unit 100*a*) are configured to function similarly to apparatus 10 (e.g., control unit 100) with respect to upper chambers 34*a*. Stated another way, fluid source 120*a* is configured to provide fluid to upper chambers 34*a* that are within head zone 104, fluid source 120*b* is configured to provide fluid to upper chambers 34*a* that are within shoulder zone 108, fluid source 120*c* is configured to provide fluid to upper chambers 34*a* that are within body zone 112, and fluid source 120*d* is configured to provide fluid to upper chambers 34*a* that are within leg zone 116, as described above for apparatus 10. Similarly, if valve 152*f* is open, fluid source 124 is configured to provide fluid to zones 104, 108, 112, and 116, as described above for apparatus 10.

Apparatus 10*a*, however, is configured such that fluid source 124 is also configured to provide fluid to lower chambers 34*b* across the entire length of mattress 30*a* (in head zone 104, shoulder zone 108, body zone 112, and leg zone 116). In the embodiment shown, control unit 100*a* (e.g., controller 136) is configured such that when if control unit 100*a* is activated to inflate mattress 30*a* from a deflated state, valve 152*f* will remain open until upper chambers 34*a* and lower chambers 34*b* are all filled to a minimum operating pressure, as described above. However, rather than deactivating fluid source 124 as described above, control unit 100*a* (e.g., controller 136) is configured to close valve 152*f* such that fluid sources 120*a*-120*d* can regulate pressure in upper chambers 34*a*, and such that fluid source 124 can regulate pressure in lower chambers 34*b*. For example, once valve 152*f* closes, fluid source 124 can continue delivering pressure to lower chambers 34*b* until lower chambers 34*b* reach a desired operating pressure, at which point fluid source 124 can be deactivated or shut off. Once fluid source 124 is deactivated, check valve 144*e* is configured to prevent the escape of fluid, such that even if no further fluid is needed in lower chambers 34*b*, fluid source 124 can still be activated to provide fluid at a lower pressure (relative to the pressure in lower chambers 34*b*) to upper chambers 34*a* (via one or more check valves 144*a*-144*d*). If the desired operating pressure for lower chambers 34*b* decreases, then valve 152*e* can be opened to vent fluid and thereby decrease pressure. Conversely, if the desired operating pressure for lower chambers 34*b* increases, then fluid source 124 can be activated (with valve 152*f* closed if the desired operating pressure in lower chambers 34*b* is higher than the desired operating pressure in any of upper chambers 34*a*) to provide additional fluid to lower chambers 34*b*.

The various illustrative embodiments of the present devices and kits are not intended to be limited to the particular forms disclosed. Rather, they include all modifications and alternatives falling within the scope of the claims. For example, embodiments other than the one shown may include some or all of the features of the depicted embodiment.

The claims are not intended to include, and should not be interpreted to include, means-plus- or step-plus-function limitations, unless such a limitation is explicitly recited in a given claim using the phrase(s) "means for" or "step for," respectively.

It will be understood that the benefits and advantages described above may relate to one embodiment or may relate to several embodiments. It will further be understood that reference to 'an' item refers to one or more of those items, unless otherwise specified. The steps of the methods described herein may be carried out in any suitable order, or simultaneously where appropriate.

Where appropriate, aspects of any of the examples described above may be combined with aspects of any of the other examples described to form further examples having comparable or different properties and addressing the same or different problems. It will be understood that the above description of embodiments is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the scope of this invention.

The invention claimed is:

1. A patient-support apparatus comprising:

a mattress with two or more inflatable zones;

two or more primary fluid sources each having a first capacity and coupled to a corresponding one of the two or more inflatable zones;

a secondary fluid source having a second capacity that k greater than the first capacity of each primary fluid source, the secondary fluid source coupled to the two or more inflatable zones;

a controller coupled to the two or more primary fluid sources and to the secondary fluid source; the controller configured to activate the secondary fluid source after the two or more zones have been initially inflated past a lower threshold pressure to provide fluid to the two or zones if the pressure in at least one of the two or more zones is below the lower threshold pressure.

2. The patient-support apparatus of claim 1, where the mattress comprises two or more layers, a first one of the two or more layers includes the two or more inflatable zones, and where:

the two or more primary fluid sources are configured to provide fluid to separate ones of the two or more zones in the first layer, and:

the secondary fluid source is configured to provide fluid to the second layer.

3. The patient-support apparatus of claim 2, further comprising an actuatable valve between the secondary fluid source and the two or more inflatable zones in the first of the two or more layers, where the controller is configured to close the actuatable valve if the pressure in the two or more inflatable zones reaches or exceeds the threshold pressure.

4. The patient-support apparatus of claim 1, further comprising:

two or more sensors configured to measure the pressure in the two or more zones of the mattress;

where the controller is configured to receive signals from the two or more sensors indicative of the pressure in the two or more zones of the mattress.

5. The patient-support apparatus of claim 1, further comprising:

two or more check valves disposed between the secondary fluid source and the two or more zones of the mattress such that the two or more check valves permit fluid to flow through the two or more check valves away from the secondary fluid source, and substantially prevent fluid from flowing through the two or more check valves toward the secondary fluid source.

6. The patient-support apparatus of claim 1, where the controller is configured to deactivate the secondary fluid source when the pressure in each of the two or more zones of the mattress reaches the lower threshold pressure.

7. The patient-support apparatus of claim 6, where the controller is configured to activate each of the primary fluid sources to provide fluid to the corresponding zones if the pressure in the corresponding zone is below a target pressure.

8. The patient-support apparatus of claim 1, further comprising:

a frame having a seat portion and a back portion configured to pivot between a lowered position and a raised position;

a sensor configured to detect the angle of the back portion of the frame; and where the mattress is supported above at least a part of the frame;

where at least one of the two or more zones is a seat zone corresponding to the seat portion of the frame.

9. The patient support apparatus of claim 8, where the controller is configured to isolate the seat zone if the angle of the back portion exceeds a threshold angle.

10. The patient-support apparatus of claim 9, where the controller is configured to activate the primary fluid source corresponding to the seat zone to increase the pressure in the seat zone if the angle of the back portion exceeds the threshold angle.

11. A control unit for a mattress having two or more inflatable zones, the control unit comprising:

two or more primary fluid sources each having a first capacity and configured to be coupled to a different one of the two or more zones of the mattress;

a secondary fluid source having a second capacity that is greater than the first capacity of each primary fluid source, the secondary fluid source configured to be coupled to each of the two or more zones of the mattress;

a controller coupled to the two or more primary fluid sources and to the secondary fluid source;

where the controller is configured such that if the primary fluid sources and the secondary fluid source are coupled to the two or more zones of a mattress, the controller will activate the secondary fluid source after the two or more zones have been initially inflated past a lower threshold pressure to provide fluid to the two or more zones if the pressure in at least one of the two or more zones is below the lower threshold pressure.

12. The control unit of claim 11, where the control unit is configured to be coupled to a mattress having two or more layers, in which a first one of the two or more layers includes the two or more inflatable zones, such that:

the two or more primary fluid sources are configured to provide fluid to separate ones of the two or more zones in the first layer, and:

the secondary fluid source is configured to provide fluid to the second layer.

13. The control unit of claim 12, further comprising an actuatable valve between the secondary fluid source and the two or more inflatable zones in the first of the two or more layers, where the controller is configured to close the actuatable valve if the pressure in the two or more inflatable zones reaches or exceeds the threshold pressure.

* * * * *